United States Patent [19]

Blaschke

[11] 4,250,559

[45] Feb. 10, 1981

[54] COORDINATE CONVERTER FOR CHANGING POLAR VECTOR VARIABLE INTO CARTESIAN VECTOR VARIABLES

[75] Inventor: Felix Blaschke, Erlangen, Fed. Rep. of Germany

[73] Assignee: Siemens Aktiengesellschaft, Munich, Fed. Rep. of Germany

[21] Appl. No.: 27,152

[22] Filed: Apr. 4, 1979

[30] Foreign Application Priority Data

Apr. 17, 1978 [DE] Fed. Rep. of Germany ..... 2816614

[51] Int. Cl.[3] ..... G06G 7/22

[52] U.S. Cl. ..... 364/815; 364/817

[58] Field of Search ..... 364/815, 816, 817, 851, 364/858

[56] References Cited

U.S. PATENT DOCUMENTS

| | | | |
|---|---|---|---|
| 2,927,734 | 3/1960 | Vance | 364/817 |
| 3,457,394 | 7/1969 | Grado | 364/815 |
| 3,705,980 | 12/1972 | Brickner et al. | 364/817 X |
| 3,825,738 | 7/1974 | Blaschke et al. | 364/817 |
| 3,974,367 | 8/1976 | Mayer | 364/815 X |

FOREIGN PATENT DOCUMENTS

| | | | |
|---|---|---|---|
| 963159 | 2/1975 | Canada | 364/817 |

*Primary Examiner*—Joseph F. Ruggiero
*Attorney, Agent, or Firm*—Kenyon & Kenyon

[57] ABSTRACT

A coordinate converter distinguished by low cost of hardware and useful for the field-oriented control of a rotating-field machine contains two multipliers, an adder and a subtraction element in a logic circuit. Optionally, two proportional elements can be added thereto. With this coordinate converter, the two Cartesian coordinates can be determined. If the magnitude is constant, the coordinate converter can be used as a sine-cosine generator. In addition, a supplemental circuit for generating a rotating vector is described.

16 Claims, 8 Drawing Figures

COORDINATE CONVERTER FOR CHANGING POLAR VECTOR VARIABLE INTO CARTESIAN VECTOR VARIABLES

BACKGROUND OF THE INVENTION

1. Field of the Invention

The invention relates to a converter for changing given first and second variables, which correspond to the angle coordinate and the magnitude coordinate of a vector defined in polar coordinates, into third and fourth variables which correspond to the Cartesian coordinates of the vector.

2. Discussion of the Prior Art

A coordinate converter for changing polar vector variables into Cartesian vector variables is needed for various purposes, for instance, for testing computer modules such as a vector analyzer (as shown, for instance, in German Pat. No. 1 941 312, FIG. 5) and a vector rotator (for instance, German Pat. No. 1 941 312, FIG. 6), or for checking circuits which use such computer modules. Another application is, for instance, the frequency-independent generation of firing angle for controlling the electric valves of a converter (see, for instance, German Auslegeschrift No. 2 620 992, FIG. 1, for the formation of variables e1 and e2). The requisite coordinate converter should be capable, if the polar coordinates (magnitude and angle) of a vector are given, of forming the Cartesian coordinates of the vector, the one coordinate axis being identical with the reference axis for the angle.

In Siemens-Zeitschrift 45 (1971), no. 10, pages 757 to 760, especially FIG. 7 on page 759, a computing circuit is described which forms two output variables a1 and a2 from three input variables sin $\alpha$, cos $\alpha$ and a. Here the two input variables sin $\alpha$ and cos $\alpha$ represent the angle $\alpha$ and the input variable a represents the magnitude of a given vector. The output variables a1 and a2 represent the Cartesian coordinates of this vector. In this case, the computing circuit consists of two multipliers; adders are not required. In the known computing circuit, however, the two input variables, sin $\alpha$ and cos $\alpha$, i.e., two trigonometric functions of the angle $\alpha$, must be given. The trigonometric functions must be generated, for instance, by two function generators, which, given the usual accuracy requirements, requires a large expenditure of means. It is therefore desirable to avoid such function generators.

It is an object of the present invention to provide a coordinate converter of the type mentioned above for processing a vector and, which needs only two input variables while, nevertheless, being distinguished by the small amount of hardware required. The coordinate converter should therefore make it possible to calculate from the polar coordinates of a given vector the corresponding Cartesian coordinates.

SUMMARY OF THE INVENTION

According to the invention, this problem is solved by means of a first and a second multiplier in conjunction with an adder and a subtractor, the first variable being fed to the first input of the first multiplier and the output variable of the adder to the second input of the first multiplier. The adder, in turn, is addressed by the second variable and the output variable of the subtraction member. The output variable of the first multiplier is taken off as the fourth variable and is also fed to one input of the second multiplier. The other input of the second multiplier is addressed by the first variable. The second variable is fed to the adding input of the subtraction member and the output variable of the second multiplier is fed to the subtracting input of the subtraction number. The output variable of the subtraction member is taken off as the third variable.

The coordinate converter of the present invention constitues a basic unit for forming Cartesian coordinates from the polar coordinates of a vector. The given polar coordinates are the magnitude and the tangent of one-half of the angle which can be measured between a coordinate axis and the vector, i.e., a quantity similar to an angle. With such a so-called PT/K converter (PT for "polar-tangent", K for "Cartesian"), which is of very simple design, certain problems can be satisfactorily solved. The operating range for angle being between +90° and −90°, however, rotating vectors can not be processed with a coordinate converter in this form.

To expand the operating range, the output variable of the adder is fed to the second input of the first multiplier via a first proportional member, and the output variable of the second multiplier is fed to the subtraction member via a second proportional member. The factors of the two proportional members determine the size of the effective angle range.

Frequently, a variable which is not proportional to the tangent of one-half the angle but is directly proportional to this angle is available as the first variable. In that case and, also, if the non-linear relationship between the input variable at the angle input and the angle of the output vector is not a disturbing factor, the basic equipment can be supplemented by equipment for determining the mentioned tangent of one-half the angle from a fifth variable which is proportional to the angle of the vector.

Another, further, embodiment of the coordinate converter is therefore distinguished by the feature that the first variable is formed in a supplementary unit by means of a fifth variable which is proportional to the angle coordinate of the vector, the supplemental unit containing three additional proportional members, a second subtraction member, a divider and a second adder. Here the first variable is taken off at the output of the subtraction member through the third proportional member. The adding input of the subtraction member is, in turn, addressed by the fifth variable and the subtracting input by the output variable of the divider which is fed to it via the fourth proportional member. The fourth variable is fed to the dividend input of the divider and the output variable of the second adder to the divisor input. The adder is fed, on the one hand, a constant input quantity and, on the other hand, via the fifth proportional member, the third variable.

This supplemental unit forms the first variable as an auxiliary variable at its output. The angle $\alpha$ of the vector is accurately correlated with the fifth variable down to an error of ±0.5°. Under certain conditions, the supplemental equipment can be further simplified by leaving out some of the building blocks.

The coordinate converter mentioned so far is suitable only for processing a non-rotating vector. By the addition of some further components, however, it can also be used for converting a rotating vector. According to the invention, such an addition is distinguished by the feature that the unipolar third variable which is taken off at the output terminal is fed to a circuit for an inputoriented inverter operation, at the output of which a bipolar third variable is taken off.

A coordinate converter in accordance with the invention is an analog computer which can be used for processing of non-rotating or of rotating vectors. It needs only a few simple components, essentially adders and multipliers. It is also advantageous in that it can be used as a sine-cosine generator when the second variable is a constant. Finally, it is of considerable advantage that characteristic-curve generators, e.g. function generators, are not required.

DETAILED DESCRIPTION OF THE INVENTION

Figure 1:
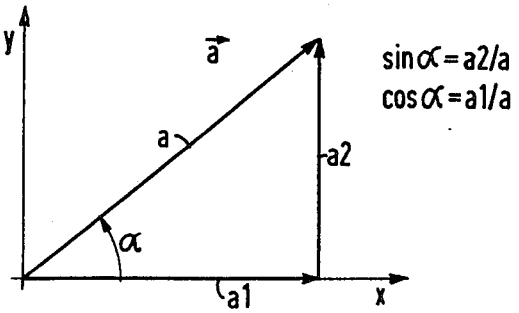
FIG. 1 is a graphical representation of a vector in the biaxial Cartesian system and in the polar coordinate system.

According to FIG. 1, a vector is defined by its angle coordinate $\alpha$ and its magnitude coordinate a. The angle coordinate $\alpha$ defines the angle between the vector and the coordinate axis x of a Cartesian coordinate system x, y. The vector $\vec{a}$ is thus defined at the same time in the Cartesian coordinate system x, y by the two variables a1 and a2. These can be, in particular, two electrical analog quantities for the components of the magnetic flux required in the field-oriented control of a rotating-field machine. There, it is necessary to calculate from an angle-like variable, tan $\alpha/2$, or from the angle coordinate $\alpha$, itself, as well as from the magnitude coordinate a, which are given by a respective first and second variable, a third and a fourth variable a1 and a2, which are a measure for the x-component and the y-component, respectively, of the vector $\vec{a}$. In the following, the (electrical) variables are designated in the same way as the corresponding components of the vector $\vec{a}$.

The coordinate converter described in the following is an analog computing circuit which is based on the known relations $$\tan \alpha/2 = \sin \alpha/(1+\cos \alpha) \text{ and} \quad (1)$$

$$\tan \alpha/2 = (1-\cos \alpha)/\sin \alpha. \quad (2)$$

If these relations (1) and (2) are expanded by the amount a, one obtains, taking into consideration the relations indicated in FIG. 1, $\sin \alpha = a2/a$ and $\cos \alpha = a1/a$, the relations $$\tan \alpha/2 = a2/(a+a1) \text{ and} \quad (3)$$

$$\tan \alpha/2 = (a-a1)/a2. \quad (4)$$

Rearranging, Eq. (3) becomes $$a2 = \tan \alpha/2\ (a-a1) \quad (5)$$

and from Eq. (4) one obtains the relation $$a1 = -\tan \alpha/2 \cdot (a2+a). \quad (6)$$

Thus, in the computing circuit, the variable a2 is first determined according to relation (5) from tan $\alpha/2$ and a, as well as the not yet known variable a1. The as yet unknown variable a1 is assumed as quasi-known and is taken off at the output of the coordinate converter. Using this result for the variable a2, the variable a1 is obtained from the relation (6), which, in turn, is substituted in Eq. (5).

Taking into consideration a proportionallty constant K, which represents a scaling factor, the relations (5) and (6) become:

$$a2 = K \cdot \tan \alpha/2 \cdot (a+a1)/K \quad (7)$$

$$a1 = -K \cdot \tan /2 \cdot (a2/K+a) \quad (8)$$

Figure 2:
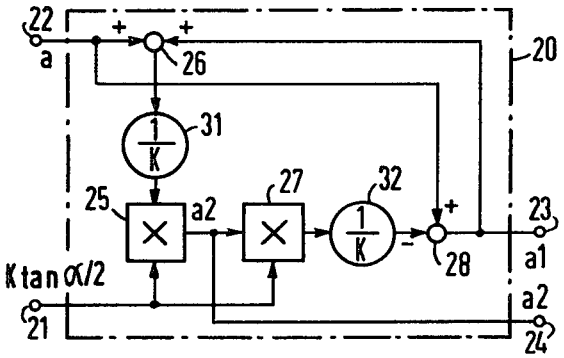
FIG. 2 is a block diagram of a simple embodiment of a coordinate converter designed in accordance with the invention.

The coordinate converter 20 shown in FIG. 2, which is intended for coordinate conversion of a non-rotating vector $\vec{a}$, is based on Equations (7) and (8).

As shown in FIG. 2, the first variable K.tan $\alpha/2$ is fed to a coordinate convertor 20 at a first input terminal 21 and the second variable a, at a second input terminal 22. The first variable K·tan $\alpha/2$ is a bipolar variable in, for instance, the range $-10$ V to $+10$ V. The second variable a is a unipolar positive variable, which is, for instance, in the range 0 to $+10$ V. In a special case, both quantities can also be constant. Thus, if the first variable changes from $-10$ V to $+10$ V, this corresponds, with $K=1$, to a change of the angle $\alpha$ from $-90°$ to $+90°$. The third and fourth variables a1 and a2, respectively, are taken from the output terminals 23 and 24. These quantities a1, a2 are accordingly variable and are also constant in the special case mentioned.

The coordinate converter 20 contains a first multiplier 25, an adder 26, a second multiplier 27 and a subtraction member 28, to which are further added a first and a second proportional member 31 and 32 having the proportionality factors $1/K \neq 1$. When the proportionality constant K of the two proportional members 31 and 32 is chosen as 1, then the coordinate converter 20 operates in accordance with equations (5) and (6) are given.

The fourth variable a2 is formed in accordance with Eq. (7) by means of first multiplier 25 and adder 26. To this end, the first input of first multiplier 25 is addressed by the first variable K·tan $\alpha/2$ and the second input by the output variable of adder 26 fed to it by way of proportional member 31. The two inputs of adder 26 are, in turn, fed the second variable a as well as the third variable a1 taken off at output terminal 23. The output variable a2 of first multiplier 25 is passed on via two paths. For one, it is brought to output terminal 24, where it is available for further processing; secondly, it is fed to one input of second multiplier 27. The other input of multiplier 27 is addressed by the first variable K·tan $\alpha/2$. The output of multiplier 27 is followed by second proportional member 32, the output of which feeds subtraction member 28 in a connection of negative polarity. Subtraction member 28 is further addressed in positive polarity by the second variable a. The output variable of subtraction member 28 is brought, as the third variable a1, to output terminal 23. In the logic circuit shown, the second multiplier 27, the proportional member 32 and the subtraction member 28 realize Equation (8).

The coordinate converter illustrated in FIG. 2 is of particularly simple design. It requires but few components.

In principle, as was mentioned above, the proportionality constant K in Equations (7) and (8) can be set equal to 1, i.e., the proportional members 31 and 32 could be omitted. The functional members 25 to 28 can be suitably connected operational amplifiers. In such case, as will be understood by those skilled in the art, the output voltages of integrated circuits can only be within a certain operating range, the upper limit of which is, for instance 10 V. Since the individual output variables must in general not exceed this limit, which will be normalized to the value 1 in the following considerations, the calculating range of a coordinate converter 20 as shown, without proportional members 31 and 32, extends only over a range from $-1$ to $+1$ with respect to the variable tan $\alpha/2$; i.e., the angle $\alpha$ extends over a range from $-90°$ to $+90°$ for $K=1$. However, if the variable K tan $\alpha/2$ with the constant $K=1$ is assigned to input terminal 21 in the manner shown instead of the variable tan $\alpha/2$, then the calculating range is expanded to $$-1/K \leqq \tan \alpha/2 \leqq +1/K. \quad (9)$$

For $K=0.7$, for instance, one obtains an operating range, for the angle $\alpha$, of $-110°$ to $+110°$ and for $K=0.466$, an operating range from $-130°$ to $+130°$.

Figure 3:
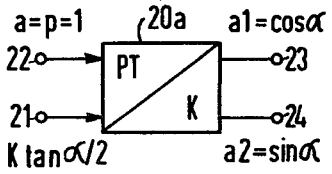
FIG. 3 is a block diagram illustrating the use of the coordinate converter of FIG. 2 as a sine-cosine generator.

As shown in FIG. 3, the coordinate converter of FIG. 2 can advantageously be used as a sine-cosine generator, the second variable a being equal to a constant p, which, in the normalized case, is set equal to 1. This coordinate converter is designated 20*a* in the drawing.

Figure 4:
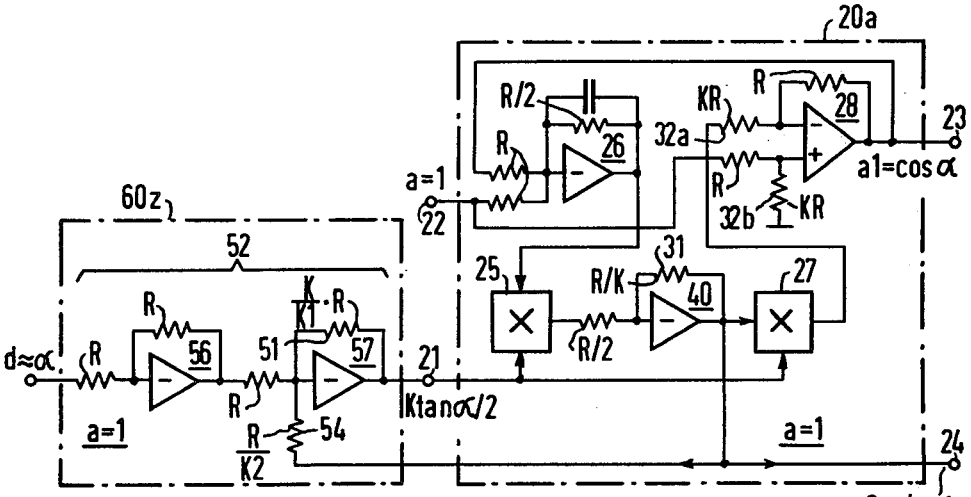
FIG. 4 is a detailed schematic diagram of a coordinate converter consisting of the basic unit and a supplemental unit.

An particularly simple embodiment, equipment-wise, of the coordinate converter 20*a* for the case a=1 is shown in FIG. 4. This growth represents a basic unit. Also illustrated is an associated supplemental unit 60*z* which will be explained later on.

As can be seen from FIG. 4, coordinate converter 20*a* is constructed from suitably connected operational amplifiers. In FIG. 4, the individual functional stages are provided with the same reference symbols as in FIG. 2. The proportions of the resistance of individual ohmic resistors are also given, as referred to the base value R, which may be, for instance, 20 kohm.

An inverting amplifier 40 is arranged between multipliers 25 and 27. A resistor having the value R/K is inserted in the feedback path of amplifier 40. This resistor therefore serves as first proportional member 31. While comparison of FIGS. 2 and 4 shows proportional member 31 connected to the input of multiplier 25, it will be evident to those skilled in the art that ultimately it does not matter whether proportional member 31 is placed at the input or at the output. At the same time inverting amplifier 40 provides signal matching.

Adder 26 and subtraction member 28 are likewise constructed as operational amplifiers having suitable external circuitry. A stabilization capacitor is connected in shunt with the feedback resistor of adder 26. The two series resistors of subtraction member 28 are made unequal. The series resistor at the positive input has a resistance R, while the series resistor at the negative input and the divider resistor at the positive input have a resistance KR. The two last-mentioned resistors 32*a* and 32*b* therefore constitute second proportional member 32, providing the desired proportionality constant 1/K.

In the coordinate converters 20 and 20*a* of FIGS. 2 to 4, it was assumed that a first variable K·tan $\alpha/2$ is available as a measure for the angle $\alpha$. As is well known, the function tan $\alpha/2$ is proportional to the angle $\alpha$ in good approximation over a rather wide range around the angle $\alpha=0$. In many cases, however, a first variable K·tan $\alpha/2$, which is proportional to the tangent of one-half the angle, is not directly available; rather, a fifth variable d is often made available as the input variable, to which the angle $\alpha$ is directly proportional. Since the fifth variable d cannot be fed directly to the input erminal 21, an adaptation between the fifth variable d and the auxiliary variable tan $\alpha/2$ must be made. According to the present invention, this can be done by means of the supplemental unit associated with the basic converter unit. This supplemental unit, by means of which the coordinate converters 20 and 20*a* shown in FIGS. 2 and 4, respectively, can be expanded into a true P/K converter, will be described in detail in the following.

The following relation is used for the adaptation:

$$d = K1 \tan \alpha/2 + K2a2\,(a + K3a1), \quad (10)$$

where the factors K1, K2 and K3 are constants that can be selected. By rearranging relation (10), the following calculating instruction is obtained:

$$K \cdot \tan \alpha/2 = Kd/K1 - KK2/K1 \cdot a2/(a + K3a1). \quad (11)$$

It can be seen from equation (11) that the first variable K·tan $\alpha/2$ is composed of two terms, the first term being proportional to the fifth variable d. The fifth variable d takes the part of a variable increasing proportionally with the angle $\alpha$. For the special case a=1, i.e., for a design as a sine-cosine generator, the relation (11) becomes:

$$K \cdot \tan \alpha/2 = Kd/K1 - KK2/K1 \cdot \sin \alpha/(1 + K3 \cos \alpha) \quad (12)$$

Figure 5:
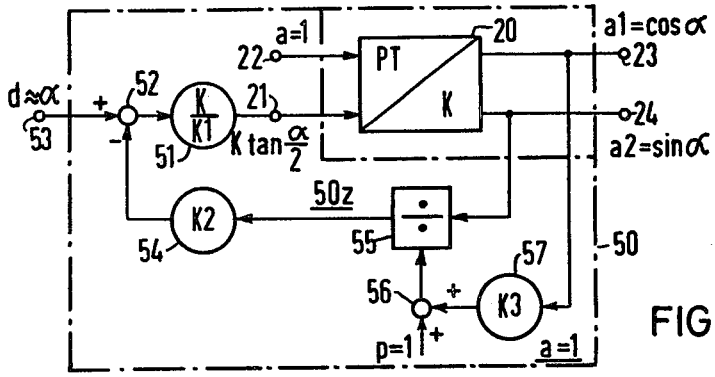
FIG. 5 is a block diagram of diagram of another embodiment of a coordinate converter consisting of a basic unit and a supplemental unit.

The coordinate converter 50 shown in FIG. 5 for a sine-cosine generator having the fifth variable d as the linear angle input is obtained from this relationship.

According to FIG. 5, a coordinate converter 20 like that described above is supplemented by a unit 50*z*. Supplemental unit 50*z* contains a third proportional member 51 having a proportionality constant K/K1, a second subtraction member 52, a fourth proportional member 54 having proportionality constant K2, a divider 55, a second adder 56, and a fifth proportional member 57 having proportionality constant K3.

In detail, the output variable of second subtraction member 52 is fed via third proportional member 51 to input terminal 21 of coordinate converter 20. The first input of subtraction member 52 is addressed positively by the fifth variable d from input terminal 53. The second input is addressed negatively from the output of divider 55 via fourth proportional member 54. The fourth variable a2 is taken off of one output of converter unit 20 and fed to the dividend input of divider 55, the output variable of second adder 56 being fed to the divisor input. Second adder 56, in turn, is addressed, on the one hand, by a constant input quantity p=1 and, on the other hand, by third variable a1 via fifth proportional member 57.

Figure 6:
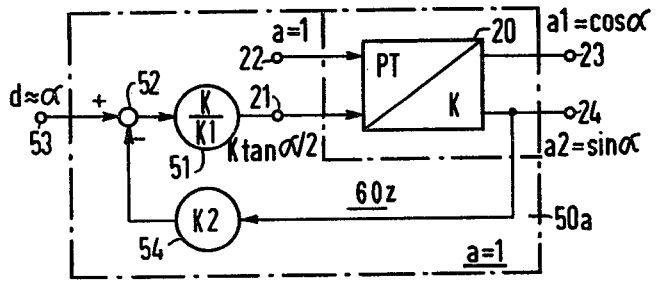
FIG. 6 is a block diagram of a simplified supplemental unit.

For the case K3=0 in the relation (12), the circuit shown in FIG. 5 is reduced to the coordinate converter 50*a* shown in FIG. 6. It is evident that the supplemental equipment 60*z* detailed here needs fewer components than supplemental equipment 50*z* of FIG. 5. Thus, divider 55 is omitted and fourth variable a2 is fed directly to fourth proportional member 54 and thence, negatively, to the second input of subtraction member 52.

A detailed circuit illustrating one embodiment of supplemental unit 60*z* can be seen in FIG. 4. Suitably connected operational amplifiers are again used as functional elements. According to FIG. 4, the fifth variable d is fed to an operational amplifier 56, which is followed by a summing amplifier 57. One series resistor, connected between the output of operational amplifier 56 and the input of amplifier 57, has the resistance R; another series resistor, also connected to the input of amplifier 57, has the value R/K2. The resistor in the feedback path of summing amplifier 57 has the value KR/K1. This resistor can therefore be considered as the proportional member 51, while the last-mentioned series resistor represents the proportional member 54. Both amplifiers 56 and 57, therefore, represent the subtraction member 52, including the proportional members 51, 54. The output of the summing amplifier 57 is brought to input terminal 21. There, the first variable K·tan $\alpha/2$ can be taken off.

If the values K1=0.707 and K2=0.293 are assumed as an example, an operating range for the angle $\alpha$ from $-90°$ to $+90°$ and a maximum error of $\pm 0.5°$ are obtained. For the values K1=0.516 and K2=0.280, a larger operating range for the angle $\alpha$ is obtained which is between $-110°$ and $+110°$, at a maximum error of $\pm 1.6°$.

Figure 7:
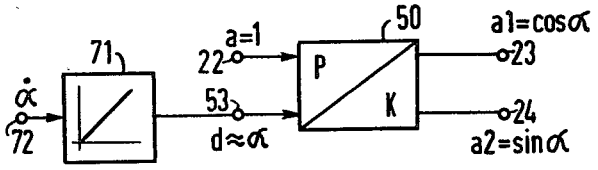
FIG. 7 is a block diagram of a coordinate converter preceded by an integrator.

FIG. 7 shows that the coordinate converter 50 (or the coordinate converter 50*z*) is made into a sine-cosine generator having a settable angular velocity (frequency $\dot{\alpha}$) by inserting an integrator 71 ahead of the input terminal 53. Such a circuit can be used particularly for controlling and regulating a rotating-field machine.

Figure 8:
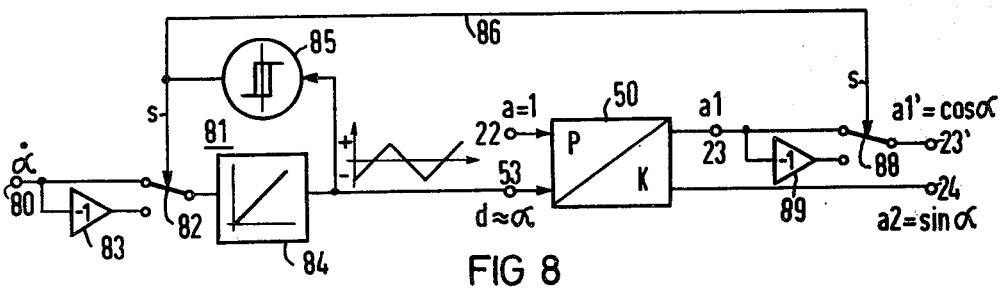
FIG. 8 is a block diagram of a coordinate converter for generating a rotating vector in a preferred embodiment.

It has been assumed so far that the vector $\vec{a}$ to be generated is a non-rotating vector. However, if the vector $\vec{a}$ to be generated in FIG. 1 is to be a vector rotating with the angular velocity $\dot{\alpha}$, the procedure can be to generate a triangular voltage going up and down with a pre-determinable angular velocity $\dot{\alpha}$; the increasing voltage is associated with the right-hand half-plane of the diagram shown in FIG. 1 and the descent with the left half-plane. This can be accomplished by switching the variable a1. The circuit shown in FIG. 8 is based on this principle. It is particularly important and is also suitable for controlling and regulating a rotating-field machine.

According to FIG. 8, a frequency signal $\dot{\alpha}$ is given to a triangle generator 81 at an input terminal 80. This frequency signal $\alpha$ is only positive; it is a measure for the frequency of the rotating vector $\vec{a}$. In the illustrative embodiment, the triangle generator 81 consists of a double-throw switch 82, an inverting amplifier 83, an integrator 84 and a threshold stage 85, which has a predetermined hysteresis. The double-throw switch 82 is operated by a control signal s, which is the output signal of threshold stage 85. In the switch position shown, the integrator 84 ascends linearly; in the other switch position it descends linearly. At the output of integrator 84, a triangular signal d having a positive or a negative slope is obtained. The waveform is shown in the drawing as the bipolar signal d being fed as the fifth variable to input terminal 53 of P/K converter 50. The variable d provides motion of the angle $\alpha$ of the output vector (corresponding to the variables a1, a2 at the output terminals 23, 24) between $-90°$ and $+90°$. An output terminal 23' can be connected to output terminal 23 by means of a further double-throw switch 88, either directly, or via an inverting amplifier 89. The sign of the output variable a1' at output terminal 23 is determined by means of double-throw switch 88 and the control signal s. This output variable a1' is bipolar. The output vector obtained at the output terminals 23, 24 is a vector oscillating between $-90°$ and $+90°$. By a proper choice of sign of the variable a1 by means of double-throw switch 88, the ascent of the triangle generator 81 is imaged, for instance, into the right half-plane, and the descent of the triangle generator 81, on the other hand, into the left half-plane of FIG. 1, so that a continuously rotating output vector is obtained at output terminals 23' 24. This rotating output vector, represented by the bipolar output variables a1' and a2, is therefore formed by the input-responsive inverter operation.

What is claimed is:

1. A coordinate converter for changing first and second given variables corresponding to the angle and the magnitude coordinates, respectively, of a vector defined in polar coordinates, into third and fourth variables, corresponding to the Cartesian coordinates of the vector, comprising:

first and second multipliers, an adder and a subtraction element in which the first variable is fed to the first input of the first multiplier and the output variable of the adder is fed to the second input of the first multiplier;

the adder is addressed by the second variable and the output variable of the subtraction element;

the output variable of the first multiplier is taken off as the fourth variable and is also fed to one input of the second multiplier;

the other input of the second multiplier is addressed by the first variable;

the second variable is additively fed to the subtraction element and the output variable of the second multiplier is fed to it subtractively; and the output variable of the subtraction element is taken off as the third variable.

2. A coordinate converter in accordance with claim 1 in which the output variable of the adder is fed to the second input of the first multiplier via a first proportional element and the output variable of the second multiplier is fed to the subtraction element via a second proportional element.

3. A coordinate converter in accordance with claim 2 for use as a sine-cosine generator in which the second variable is set equal to a constant.

4. A coordinate converter in accordance with any one of claims 2 or 3 in which the first variable is formed in a supplemental unit by means of a fifth variable which is proportional to the angle coordinate of the vector where the supplemental unit comprises three further proportional elements, a second subtraction element, a divider and a second adder, and in which:

the first variable is taken via the third proportional element from the output of the subtraction element which, in turn, is addressed additively by the fifth variable and subtractively, via the fourth proportional element, by the output variable of the divider;

the fourth variable is fed to the dividend input of divider and the output variable of second adder is fed to the divisor input; and one input of the second adder is fed a constant input quantity and the other is fed the third variable via the fifth proportional element.

5. A coordinate converter in accordance with any one of claims 2 or 3 in which the first variable is formed in a supplemental unit by means of a fifth variable which is proportional to the angle coordinate of the vector and in which the supplemental unit contains two further proportional elements and a second subtraction element, the first variable being taken via the third proportional element from the output of the subtraction element, which is addressed additively by the fifth variable and subtractively, via the fourth proportional element, by the fourth variable.

6. A coordinate converter in accordance with claim 4 for use as a sine-cosine generator having a settable frequency signal in which the fifth variable is taken from the output of an integrator having the frequency signal fed to its input.

7. A coordinate converter in accordance with any one of the claims 1 to 3 for use in generating a rotating vector in which the unipolar third variable which is taken from the output terminal is fed to an input-responsive inverter, at the output of which a bipolar third variable is taken off.

8. A coordinate converter in accordance with claim 7 in which the first variable is furnished by a triangle generator to which a frequency signal is fed, and that the ascending or descending output signal of this triangle generator is fed, via a control line, to the inversion circuit as the control signal for the input-responsive inversion.

9. A coordinate converter in accordance with claim 5 for use as a sine-cosine generator having a settable frequency signal in which the fifth variable is taken from the output of an integrator having the frequency signal fed to its input.

10. A coordinate converter in accordance with claim 1 for use as a sine-cosine generator in which the second variable is set equal to a constant.

11. A coordinate converter in accordance with any one of claims 1 or 10 in which the first variable is formed in a supplemental unit by means of a fifth variable which is proportional to the angle coordinate of the vector where the supplemental unit comprises three proportional elements, a second subtraction element, a divider and a second adder, and in which:

the first variable is taken via a first of the proportional elements from the output of the subtraction element which, in turn, is addressed additively by the fifth variable and subtractively, via a second of the proportional elements, by the output variable of the divider;

the fourth variable is fed to the dividend input of divider and the output variable of second adder is fed to the divisor input; and one input of the second adder is fed a constant input quantity and the other is fed the third variable via the third of the proportional elements.

12. A coordinate converter in accordance with any one of claims 1 or 10 in which the first variable is formed in a supplemental unit by means of a fifth variable which is proportional to the angle coordinate of the vector and in which the supplemental unit contains two further proportional elements and a second subtraction element, the first variable being taken via a first of the proportional elements from the output of the subtraction element, which is addressed additively by the fifth variable and subtractively, via the second of the proportional elements by the fourth variable.

13. A coordinate converter in accordance with claim 11 for use as a sine-cosine generator having a settable frequency signal in which the fifth variable is taken from the output of an integrator having the frequency signal fed to its input.

14. A coordinate converter in accordance with claim 12 for use as a sine-cosine generator having a settable frequency signal in which the fifth variable is taken from the output of an integrator having the frequency signal fed to its input.

15. A coordinate converter in accordance with any one of the claims 1 or 3 for use in generating a rotating vector in which the unipolar third variable which is taken from the output terminal is fed to an input-responsive inverter, at the output of which a bipolar third variable is taken off.

16. A coordinate converter in accordance with claim 15 in which the first variable is furnished by a triangle generator to which a frequency signal is fed, and that the ascending or descending output signal of this triangle generator is fed, via a control line, to the inversion circuit as the control signal for the input-responsive inversion.

* * * * *